US006244238B1

(12) United States Patent
Takahashi et al.

(10) Patent No.: US 6,244,238 B1
(45) Date of Patent: Jun. 12, 2001

(54) CRANKCASE FOR A MULTIPLE CYLINDER ENGINE

(75) Inventors: Katsunori Takahashi, Saitama; Yoichi Tanaka, Shizuoka, both of (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/429,084

(22) Filed: Oct. 29, 1999

(30) Foreign Application Priority Data

Oct. 31, 1998 (JP) ..... 10-326018

(51) Int. Cl.[7] ..... F02F 7/00; F01M 13/00

(52) U.S. Cl. ..... 123/195 R; 123/195 H; 123/196 CP

(58) Field of Search ..... 123/196 CP, 195 R, 123/195 H, 193.2, 196 R

(56) References Cited

U.S. PATENT DOCUMENTS

| | | | | |
|---|---|---|---|---|
| 4,630,579 | * | 12/1986 | Atkin | 123/195 R |
| 4,876,998 | * | 10/1989 | Wunsche | 123/198 E |
| 5,501,189 | * | 3/1996 | Bezeij | 123/193.1 |
| 5,829,406 | * | 11/1998 | Mazzola et al. | 123/195 R |
| 5,852,992 | * | 12/1998 | Boggs et al. | 123/196 R |
| 5,868,110 | * | 2/1999 | Betsch | 123/195 R |
| 5,931,135 | * | 8/1999 | Yamada | 123/195 C |
| 6,076,495 | * | 6/2000 | Takahashi et al. | 123/196 W |

FOREIGN PATENT DOCUMENTS

| | | |
|---|---|---|
| 3727670A | 3/1989 | (DE) . |
| 2099075A | 12/1982 | (GB) . |
| 10-77905 | 3/1998 | (JP) . |

OTHER PUBLICATIONS

Patent Abstracts of Japan, vol. 013, No. 181 (E–750), 27 Apr. 1989 (Apr. 4, 1989) & JP 01–007790A (FUJI PHOTO FILM CO. LTD), Jan. 11, 1989 (Jan. 1, 1989) *abstract*.

* cited by examiner

*Primary Examiner*—Henry C. Yuen
*Assistant Examiner*—Hai Huynh
(74) *Attorney, Agent, or Firm*—Birch, Stewart, Kolasch & Birch, LLp

(57) ABSTRACT

A journal wall of an in-line four cylinder engine is provided with an oilway and bolt fastening sections. A center of a breathing hole punched in the journal wall avoids the oilway and the bolt fastening sections by being offset by a predetermined amount with respect to a center of a breathing hole formed in an adjacent journal wall. In this way, it is possible to make the diameter of the breathing hole sufficiently large to alleviate friction loss in the four cylinder engine without making the oilway complicated or shortening the bolt fastening sections.

5 Claims, 3 Drawing Sheets

CRANKCASE FOR A MULTIPLE CYLINDER ENGINE

BACKGROUND OF THE INVENTION

1. Field of the Invention

The present invention relates to a crankcase for a multiple cylinder engine, and more particularly, to a structure for providing breathing holes having a sufficient hole diameter in journal walls of the crankcase.

2. Description of Related Art

In a multiple cylinder engine, due to reciprocal movement of the pistons there are large variations in the internal pressure of the crank chamber during high-speed rotation of the crankshaft. As a result, friction loss becomes large. In order to solve this problem, breathing holes are formed which open into the journal walls. These breathing holes for each journal wall are formed by machine processing in a direction parallel to a central axis of the crankshaft with respect to a cast cylinder block; this results in each breathing hole being arranged coaxially (see, for example, Japanese patent laid-open No. Hei. 10-77905).

Oilways and bolt fastening sections are also provided in the journal walls. These oilways and bolt fastening sections are integrally formed when the cylinder block is casted. Therefore, the breathing hole diameter must be made small enough to avoid the oilways and bolt fastening sections. However, this makes it difficult to provide breathing hole diameters large enough to reduce friction loss.

SUMMARY OF THE INVENTION

In order to solve the above problem of the conventional art, it is an object of the present invention to provide a multiple cylinder engine having crank chambers for each cylinder of the multiple cylinder engine arranged along the axial direction of a crankshaft, with breathing holes communicating between the crank chambers and respective journal walls supporting the crankshaft and constituting wall sections of each crank chamber, wherein the breathing holes are lined up along the crankshaft, and at least one of the breathing holes has a center different from centers of the other breathing holes.

A further object is to provide a multiple cylinder engine where the breathing holes are provided for each journal wall, and the number of breathing holes is the same as the number of journal walls. Various combinations of breathing holes may be implemented, from a combination where only the center position of one breathing hole is different, to a combination where the center positions of all the breathing holes are different.

Another object of the present invention is to provide a multiple cylinder engine where the journal wall, in which the breathing hole having a different center is provided, has an oilway and the breathing hole is formed at a position avoiding this oilway.

Yet another object of the present invention is to provide a multiple cylinder engine, where the journal wall with the breathing hole having a different center has a bolt fastening section and the breathing hole is formed at a position avoiding this bolt fastening section.

These and other objects of the present invention are accomplished by way of a plurality of breathing holes provided in each journal wall, each of breathing holes having a center different from all the others. Therefore, it is possible to vary the position of the breathing holes according to the structure of the journal wall, with the result that the diameter of the breathing holes can be made sufficiently large to ensure an opening area sufficient to reduce friction loss.

In the case where an oilway is provided in the journal wall, since the breathing hole is formed avoiding the oilway, it is possible to form the breathing hole having a sufficiently large diameter without interfering with the oilway. Therefore, the oilway may be formed in an uncomplicated manner.

In the case where a bolt fastening section is provided in the journal wall, and the breathing hole is formed avoiding the bolt fastening sections, it is possible to form the breathing hole having a sufficiently large diameter; therefore, preventing having to shorten the length of the bolts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 2:
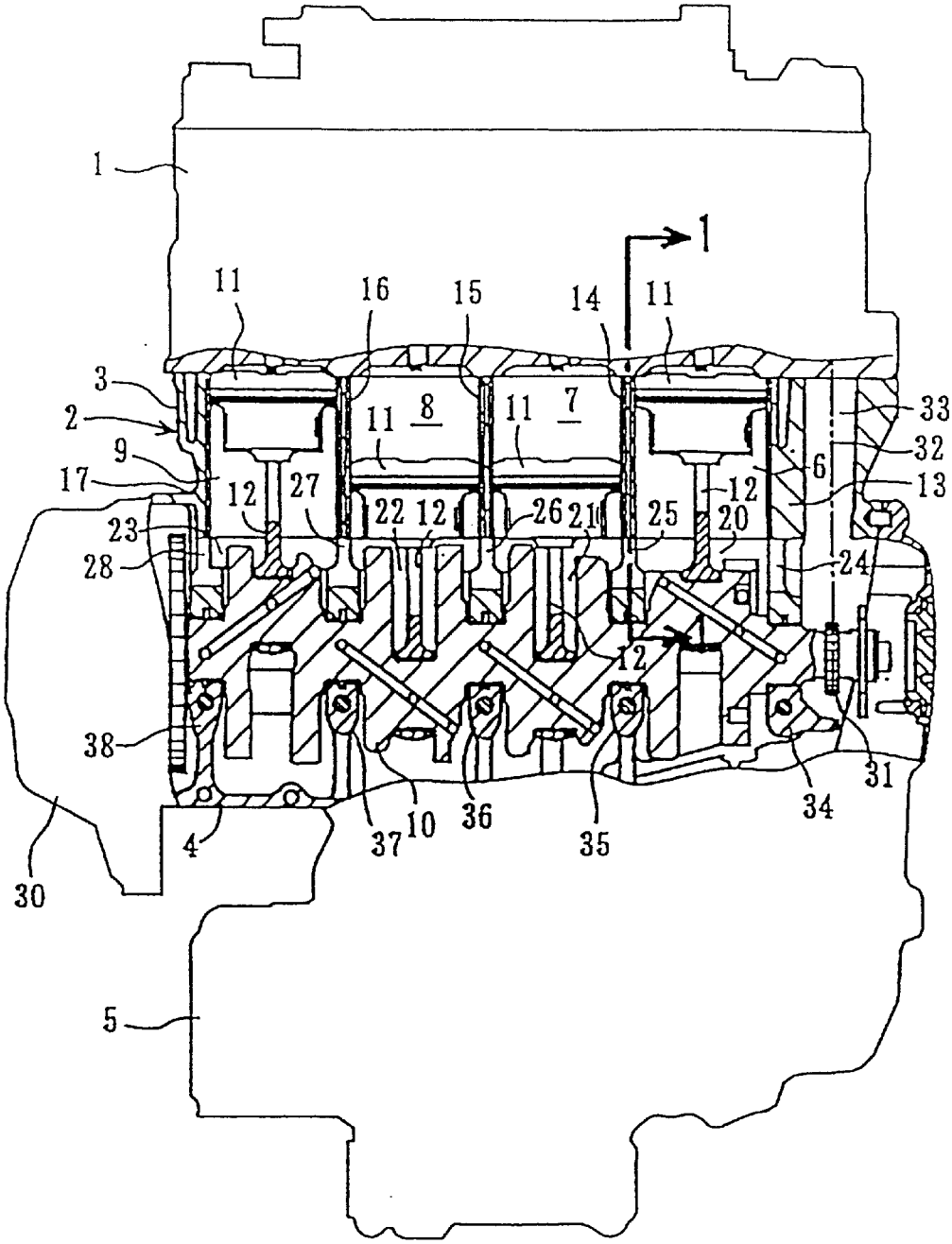
FIG. 2 is a cross-sectional view of a crank chamber section of a multiple cylinder engine.

In FIG. 2, reference numeral 1 is a cylinder head, 2 is a crankcase, 3 is a cylinder section, 4 is a lower case and 5 is a transmission. The crankcase 2 is divided into two parts, namely an upper case, that is formed integrally with the cylinder section 3, and the lower case 4.

Four cylinders 6–9 are formed in the cylinder section 3 and lined up along the axial direction of a crankshaft 10. The crankshaft 10 is connected to pistons 11 which slide within each of the cylinders 6–9 via connecting rods 12, and is supported by journal walls 13–17.

The journal walls 13–17 each define cylinders 6–9 inside the crankcase 2 and crank chambers 20–23 corresponding to these cylinders. Breathing holes 24–28 are also formed in each of the journal walls 13–17.

The breathing holes 24–28 are respectively formed one each in the journal walls 13–17, with the same diameter, and are aligned along the axial direction of the crankshaft 10 communicating with each of the crank chambers 20–23.

In FIG. 2, reference numeral 30 is an ACG cover, reference numeral 31 is a cam shaft drive sprocket, reference numeral 32 is a cam chain, reference numeral 33 is a cam chain chamber, and reference numerals 34–38 are journal walls for the crankshaft 10 at the lower case 4 side.

Next, the detailed structure of the journal walls of the cylinder section 3 will be described.

Figure 1:
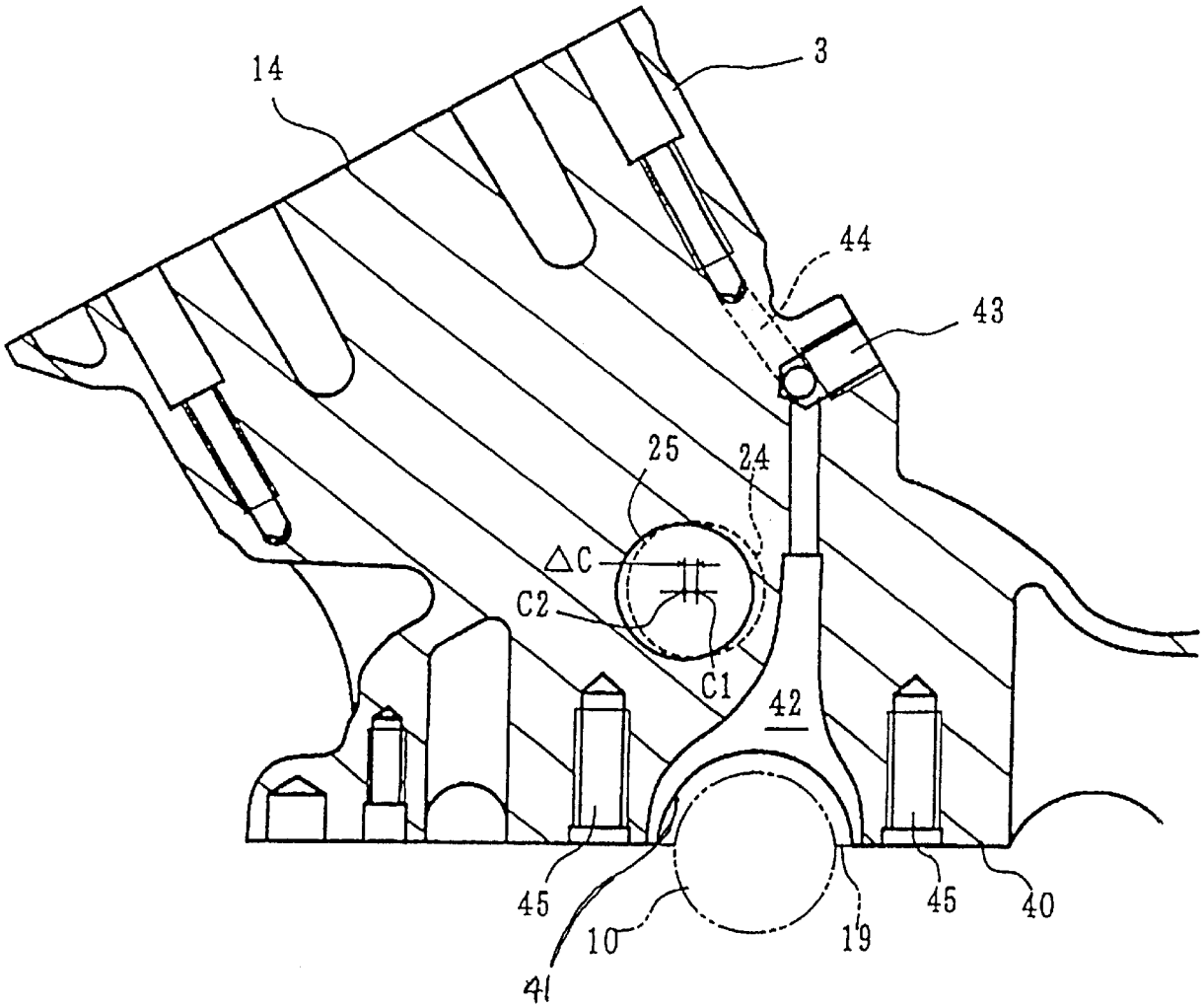
FIG. 1 is a cross-sectional view of a cylinder section taken along line 1—1 shown in FIG. 2.

FIG. 1 illustrates a journal wall 14, and a semicircular cavity 41 for housing the crankshaft 10 via a metal bearing 19 which is formed in a lower surface 40 of the journal wall 14. An oilway 42 is also formed in the circumference of this cavity 41.

The oilway 42 extends upward and leads to an attachment hole 43 for a pressure switch (omitted from the drawing) formed in a side of the journal wall 14, extends from there through a side hole to the journal wall 13 (FIG. 2), bends at a thickened part of the journal wall 13 and connects to a separate oilway 44 that extends upward.

A pair of bolt attachment screw holes 45 are formed leading upward from the lower surface 40 on either side of the cavity 41. These bolt holes 45 and bolts (not shown) facilitate the joining of the lower case 4 to the cylinder section 3.

A breathing hole 25 is formed at a position leading away from the oilway 42 and the screw holes 45. The diameter of this breathing hole 25 is sufficiently large to avoid friction loss, and is offset from a center position of a breathing hole 24 formed in the adjacent journal wall 13.

Specifically, the center C1 of the breathing hole 24 is offset by Δc from the center C2 of the breathing hole 25, and is eccentric by Δc from the oilway 42. The centers of the breathing holes 24 and 25 are also positioned a sufficient distance away from the tips of the screw holes 45.

Figure 3:
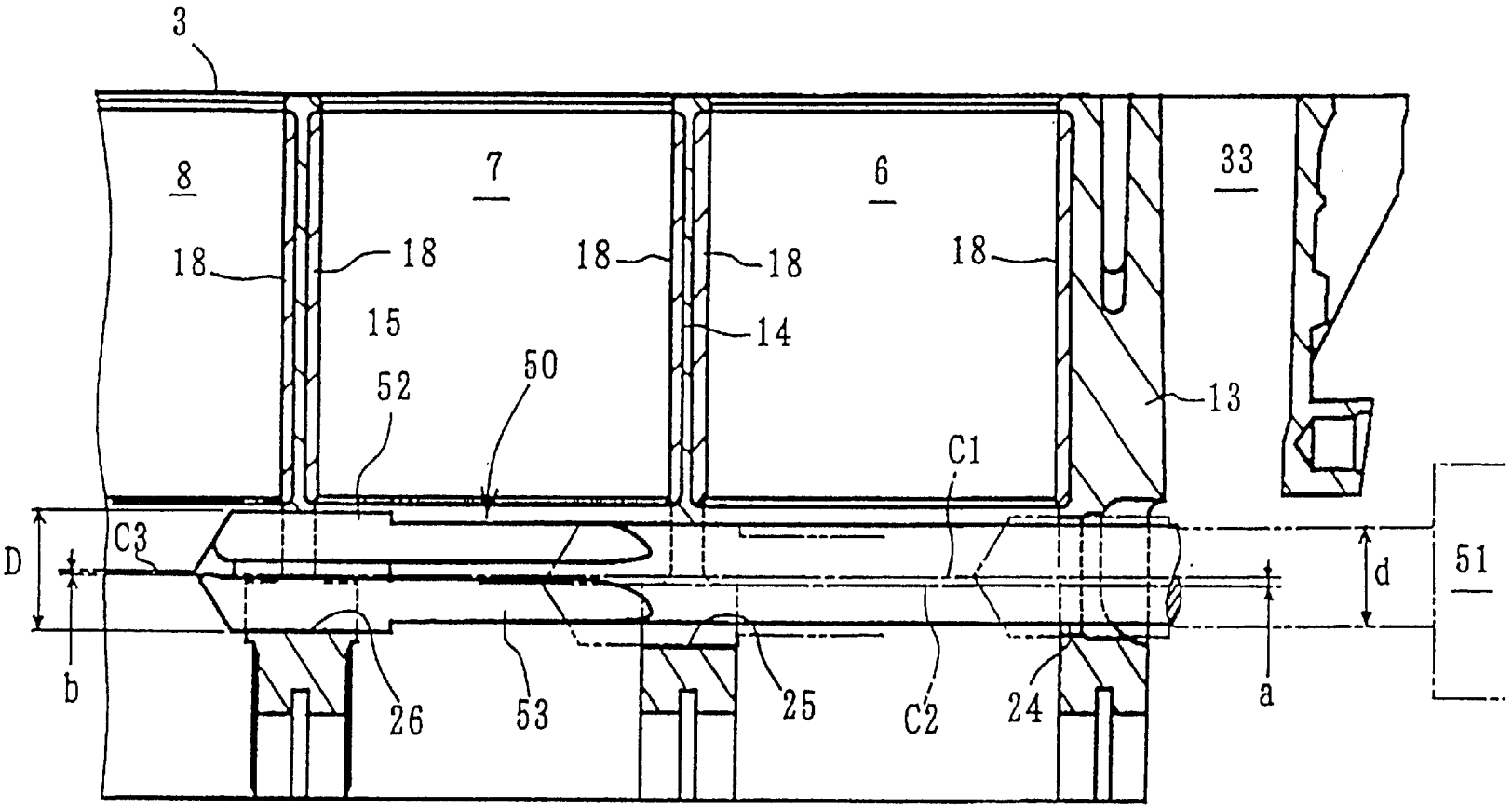
FIG. 3 is a cross-sectional view of cylinder sections illustrating formation of breathing holes.

As shown in FIG. 3, the breathing holes 24–27 are formed by punching the cast cylinder section 3 from a direction parallel to the axial direction of the crankshaft 10, using a suitable fabrication system, such as NC machine tool 51 using an implement 50. At the time the cylinder section 3 is cast, the cavity 41, oilway 42 and screw holes 45, before being tapped, etc. are integrally formed.

The implement 50 comprises a blade section 52 having an outer diameter D and a shaft section 53 having an outer diameter d smaller than the outer diameter D. The diameter D of the blade section 52 is approximately equal to the inner diameter of each of the breathing holes 24–27, while the diameter d of the shaft section 53 is determined from the maximum offset amount of the breathing holes.

First, the breathing hole 24 is punched on the center C1 using the implement 50. The blade section 52 passes through the journal wall 13, the shaft section 53 moves from there to the center C2, and the breathing hole 25 is formed in the journal wall 14. The amount of movement a of the centers at this time is equivalent to an offset amount between the breathing hole 24 and the breathing hole 25 in a vertical direction in the drawing.

After punching the breathing hole 25, the shaft section 53 is again moved by a distance b, and then the breathing hole 26 for the journal wall 15 is drilled. Thereby, the breathing hole 26 is formed having the center C3 offset by the offset amount b in a vertical direction from the center C1 of the breathing hole 24. Thereafter, the breathing hole 27 and subsequent holes are punched in the same way.

The offset amounts a and b in FIG. 3 are offset amounts in the vertical direction of the Figures. The breathing holes are also appropriately offset in the lateral direction of FIG. 1 equal to the above described Δc. This offset amount is appropriately determined taking into consideration avoidance of the oilway 42 and the screw holes 45, etc. and the structure of each of the journal walls 13–17.

The outer diameter d of the shaft section 53 is determined by referencing one of the breathing holes. For example, as described above, the breathing hole 24 is used as a reference so that a difference between the outer diameter D of the blade section 52 and the outer diameter d of the shaft section 53 is approximately at least double an offset amount by which a predetermined breathing hole is most offset from the reference breathing hole, i.e. a maximum offset amount.

Next, the operation of the present invention will be described. The oilway 42 and the screw holes 45 are provided in the journal wall 14. The breathing hole 25 is offset with respect to a breathing hole of another journal wall, for example the breathing hole 24 of the adjacent journal wall 13, so that the breathing hole 25 is formed away from the oilway 42 and the screw holes 45.

As a result, it is possible to make the diameter of the breathing hole 25 sufficiently larger, similarly to the diameter of other breathing holes, and it is possible to ensure a sufficient opening area to alleviate friction loss. Furthermore, it is possible to avoid having to form a complicated oilway passage, and to avoid the situation where the bolts are shortened as a result of the screw holes being short.

The breathing holes 24, and 26–28 for the other journal walls 13 and 15–17 are also the same and can be formed at the most convenient positions; therefore, if it is necessary for the oilway and screw holes to avoid other parts, they can be formed as such.

The present invention is not limited to the above described embodiment, and various modifications are possible, for example, the number of cylinders can be more of less than in the embodiment as long as there is more than one.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A crankcase for a multiple cylinder engine, comprising:

a crankshaft; and crank chambers arranged along an axial direction of said crankshaft, and provided with a plurality of breathing holes communicating between said crank chambers and respective journal walls supporting said crankshaft and constituting wall sections of each crank chamber, wherein said breathing holes are lined up along the crankshaft, and at least one of said breathing holes has a center offset from a center of another of said breathing holes.

2. The crankcase for a multiple cylinder engine as disclosed in claim 1, wherein said journal wall having said offset breathing hole is provided with an integral oilway, said offset breathing hole is formed at a position avoiding said integral oilway.

3. The crankcase for a multiple cylinder engine as disclosed in claim 1, wherein said journal wall having said offset breathing hole is provided with a bolt fastening section, said bolt fastening section is formed at a position avoiding said bolt fastening section.

4. The crankcase for a multiple cylinder engine as disclosed in claim 1, wherein each of said plurality of breathing holes have centers offset from each respective said plurality of breathing holes.

5. The crankcase for a multiple cylinder engine as disclosed in claim 1, further comprising an oilway formed in at least one of said journal walls, wherein said at least one of said breathing holes is center offset from another of said breathing holes by a predetermined distance and said at least one of said breathing holes is offset from said oilway by a distance equal to said predetermined distance.

* * * * *